US011807427B2

(12) United States Patent
Sakamoto et al.

(10) Patent No.: US 11,807,427 B2
(45) Date of Patent: Nov. 7, 2023

(54) DOUBLE CONTAINER POURING CAP AND DOUBLE CONTAINER

(71) Applicant: YOSHINO KOGYOSHO CO., LTD., Tokyo (JP)

(72) Inventors: Satoshi Sakamoto, Tokyo (JP); Ryo Tachikura, Tokyo (JP); Katsuhito Kuwahara, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 61 days.

(21) Appl. No.: 17/623,089

(22) PCT Filed: Jun. 26, 2020

(86) PCT No.: PCT/JP2020/025388
§ 371 (c)(1),
(2) Date: Dec. 27, 2021

(87) PCT Pub. No.: WO2020/262672
PCT Pub. Date: Dec. 30, 2020

(65) Prior Publication Data

US 2022/0258931 A1 Aug. 18, 2022

(30) Foreign Application Priority Data

Jun. 28, 2019 (JP) ..... 2019-120735
Jul. 30, 2019 (JP) ..... 2019-140360

(51) Int. Cl.
*B65D 47/20* (2006.01)
*B65D 47/32* (2006.01)

(52) U.S. Cl.
CPC ..... *B65D 47/2018* (2013.01); *B65D 47/32* (2013.01)

(58) Field of Classification Search
CPC ..... B65D 47/2018; B65D 47/32
(Continued)

(56) References Cited

U.S. PATENT DOCUMENTS 6,951,295 B1 * 10/2005 Gaus ..... B05B 11/007 222/484
2021/0362916 A1 * 11/2021 Kollia ..... B67C 3/28
2022/0258931 A1 * 8/2022 Sakamoto ..... B65D 47/2018

FOREIGN PATENT DOCUMENTS

JP 2011-031932 A 2/2011
JP 2014-024569 A 2/2014
(Continued)

OTHER PUBLICATIONS

English translation of JP 2018 034897 specification, Mar. 2018.*
(Continued)

*Primary Examiner* — Paul R Durand
*Assistant Examiner* — Michael J. Melaragno
(74) *Attorney, Agent, or Firm* — Oliff PLC

(57) ABSTRACT

A double container pouring cap that can abut an air valve in an intended state and stably exhibit performance related to the air valve, and a double container includes: an air valve that can abut on and separate from a back surface of a cap body, and blocks air flow from a vent to an outside air inlet, while allowing air flow from the outside air inlet to the vent; and an inner plug provided to face the back surface of the cap body with the air valve interposed between, and including a regulation part that abuts on a part of the air valve and limits separation of the air valve from the back surface of the cap body. A first abutting surface of the air valve where the regulation part abuts is a flat surface.

13 Claims, 7 Drawing Sheets

(58) Field of Classification Search
USPC ..... 222/397
See application file for complete search history.

(56) References Cited

FOREIGN PATENT DOCUMENTS

| | | | | | |
|---|---|---|---|---|---|
| JP | 2016-190675 | A | | 11/2016 | |
| JP | 2017-132529 | A | | 8/2017 | |
| JP | 2018034897 | A | * | 3/2018 | |
| JP | 2018-052563 | A | | 4/2018 | |
| JP | 2018-058594 | A | | 4/2018 | |
| JP | 2018-058643 | A | | 4/2018 | |
| JP | 2018052563 | A | * | 4/2018 | |
| JP | 2018058643 | A | * | 4/2018 | |
| WO | WO-2014208096 | A1 | * | 12/2014 | ..... B65D 1/0215 |
| WO | WO-2018020800 | A1 | * | 2/2018 | ..... B65D 1/0215 |
| WO | WO-2020262672 | A1 | * | 12/2020 | ..... B65D 47/2018 |

OTHER PUBLICATIONS

Sep. 24, 2020 International Search Report issued in International Patent Application No. PCT/JP2020/025388.
Sep. 24, 2020 Written Opinion issued in International Patent Application No. PCT/JP2020/025388.
Jan. 24, 2023 Office Action issued in Japanese Patent Application No. 2019-120735.
Dec. 26, 2022 Office Action issued in Chinese Patent Application No. 202080045755.7.
Aug. 23, 2022 Office Action issued in Japanese Patent Application No. 2019-120735.
Aug. 23, 2022 Office Action issued in Japanese Patent Application No. 2019-140360.
Jul. 3, 2023 Search Report issued in European Patent Application No. 20832891.4.

* cited by examiner

ENLARGED VIEW OF PART A

DEVELOPMENT VIEW SEEN FROM ARROW B (a)

(b)

DOUBLE CONTAINER POURING CAP AND DOUBLE CONTAINER

TECHNICAL FIELD

The present invention relates to a double container pouring cap that is attached to a container body including an inner layer body for accommodating the content liquid and an outer layer body for accommodating the inner layer body and pours out the content liquid when pressed against the outer layer body, and a double container with this pouring cap attached to the container body.

BACKGROUND ART

In recent years, in a container having a pouring cap is attached to a container body for accommodating a content liquid, a double container (also called a delamination container or a laminated peeling container) using a container body including an inner layer body and an outer layer body, for example, as shown in Patent Literature 1 is used. This type of outer layer body is flexible and is configured to allow air to be taken into the internal space formed between the inner layer body and the outer layer body through the through hole (vent) that penetrates the front and back. The pouring cap is provided with an air valve that prevents air from leaking from the internal space to the outside world, while allowing air to be introduced from the outside world into the internal space when the internal space is decompressed.

According to the double container having such a structure, the internal space is pressurized by pressing the outer layer body, and the pressure in the filling space is increased and the content liquid can be poured out. In addition, when the pressure on the outer layer body is released, the internal space is decompressed as the outer layer body is restored, in a manner that air is introduced from the vent to the inner space and only the inner layer body can be reduced in volume and deformed. That is, there is an advantage that the self-standability of the container is maintained even if the amount of the content liquid is reduced. In addition, since the content liquid can be poured out without being replaced with the outside air, there is an advantage that the quality of the accommodated content liquid is unlikely to deteriorate. For this reason, this type of container is being widely used as a suitable container for accommodating seasonings such as soy sauce, sauce, mirin, and cooking liquor, and cosmetics such as shampoo, conditioner, liquid soap, and lotion.

CITATION LIST

Patent Literature

Patent Literature 1: JP 2011-31932 A

SUMMARY OF INVENTION

Technical Problem

As shown in Patent Literature 1, the above-mentioned pouring cap includes an air valve inside the cap body attached to the outer layer body. The cap body includes an outside air inlet leading to the vent of the outer layer body. The air valve normally abuts on the back surface of the cap body and blocks air flow between the vent and the outside air inlet. On the other hand, when the internal space is decompressed, the air valve is elastically deformed to separate from the back surface of the cap body, and air can flow between the vent and the outside air inlet.

By the way, when the air valve and the portion where the air valve abuts deviate from the intended positions, the contact state between the two changes, in a manner that, for example, when the outer layer body is pressed, the air in the internal space leaks to the outside world and the content liquid may not be discharged as intended. In addition, there is a concern that the outside air cannot be taken in smoothly when the outer layer body is restored, and it takes time to restore the outer layer body. Further, there is a possibility that the air valve separated from the back surface of the cap body vibrates and makes a noise.

An object of the present invention is to solve such a problem and to provide a double container pouring cap that can abut an air valve in an intended state and stably exhibit performance related to the air valve, and a double container.

Solution to Problem

The present invention is a double container pouring cap attached to a container body including an inner layer body having a filling space that accommodates content liquid and an outer layer body partitioning an inner space between the inner layer body and the outer layer body and including a vent that leads to the internal space, and pours out the content liquid in the filling space by pressing the outer layer body from a pouring outlet, the double container pouring cap including: a cap body covering the vent and attached to the outer layer body, and including the pouring outlet and an outside air inlet that leads to the vent; an air valve that can abut on and separate from a back surface of the cap body, and blocks air flow from the vent to the outside air inlet, while allowing air flow from the outside air inlet to the vent; and an inner plug provided to face the back surface of the cap body with the air valve interposed between, and including a regulation part that abuts on a part of the air valve and limits separation of the air valve from the back surface of the cap body, in which a first abutting surface of the air valve where the regulation part abuts is a flat surface.

The air valve preferably includes a tubular base part, a donut plate-shaped and elastically deformable air valve body part having an inner edge fixedly supported by the base part, and an air valve outer edge part provided on an outer edge side of the air valve body part and having the first abutting surface on a side that faces the regulation part and a second abutting surface that abuts on the back surface of the cap body on a side that faces the back surface of the cap body.

The air valve body part is preferably thinner than the air valve outer edge part.

The regulation part may be a protrusion having a root part connected to the inner plug and a tip part abutting on the first abutting surface.

The inner plug may be provided to face the back surface of the cap body with the air valve interposed between, and may include a partition wall having a content liquid communication port that allows the filling space to communicate with the pouring outlet, an annular wall standing up from the partition wall, an air communication port penetrating at least one of the partition wall and the annular wall and allows the outside air inlet to communicate with the vent, and a plate-shaped part connected to the annular wall and separated from a lower surface of the air valve to extend along the outer edge part of the air valve, the plate-shaped part may include an abutting part provided at a tip of the plate-shaped part and abutting on the lower surface of the air valve, and the regulation part may include the plate-shaped part and the abutting part.

The plate-shaped part is preferably thinner than the abutting part.

The air communication port preferably penetrates at least the annular wall, and a lower surface of the plate-shaped part is preferably at a position aligned with a lower surface of the annular wall that partitions the air communication port.

The first abutting surface and a regulation part abutting surface where the regulation part abuts on the first abutting surface are preferably both flat surfaces.

The present invention is also a double container including the container body and the double container pouring cap according to any one of the above.

Advantageous Effects of Invention

In the double container pouring cap of the present invention, the inner plug is provided with a regulation part that abuts on a part of the air valve and limits the separation of the air valve from the back surface of the cap body, and the air valve is provided with a first abutting surface where the regulation part abuts. That is, when the regulation part abuts on the air valve, the air valve can be stably brought into contact with the back surface of the cap body. Further, since the vibration of the air valve is suppressed by the abutting regulation part, it is possible to suppress the noise. Furthermore, since the first abutting surface is a flat surface, the contact condition between the back surface of the cap body and the air valve does not change even if the relative positional relationship between the air valve and the regulation part changes slightly. Therefore, the performance provided by the air valve can be exhibited more stably. In the present specification and the like, the term abut includes not only a state in which the two members are in contact with each other but also a state in which the two members are slightly separated from each other.

DESCRIPTION OF EMBODIMENTS

Figure 1:
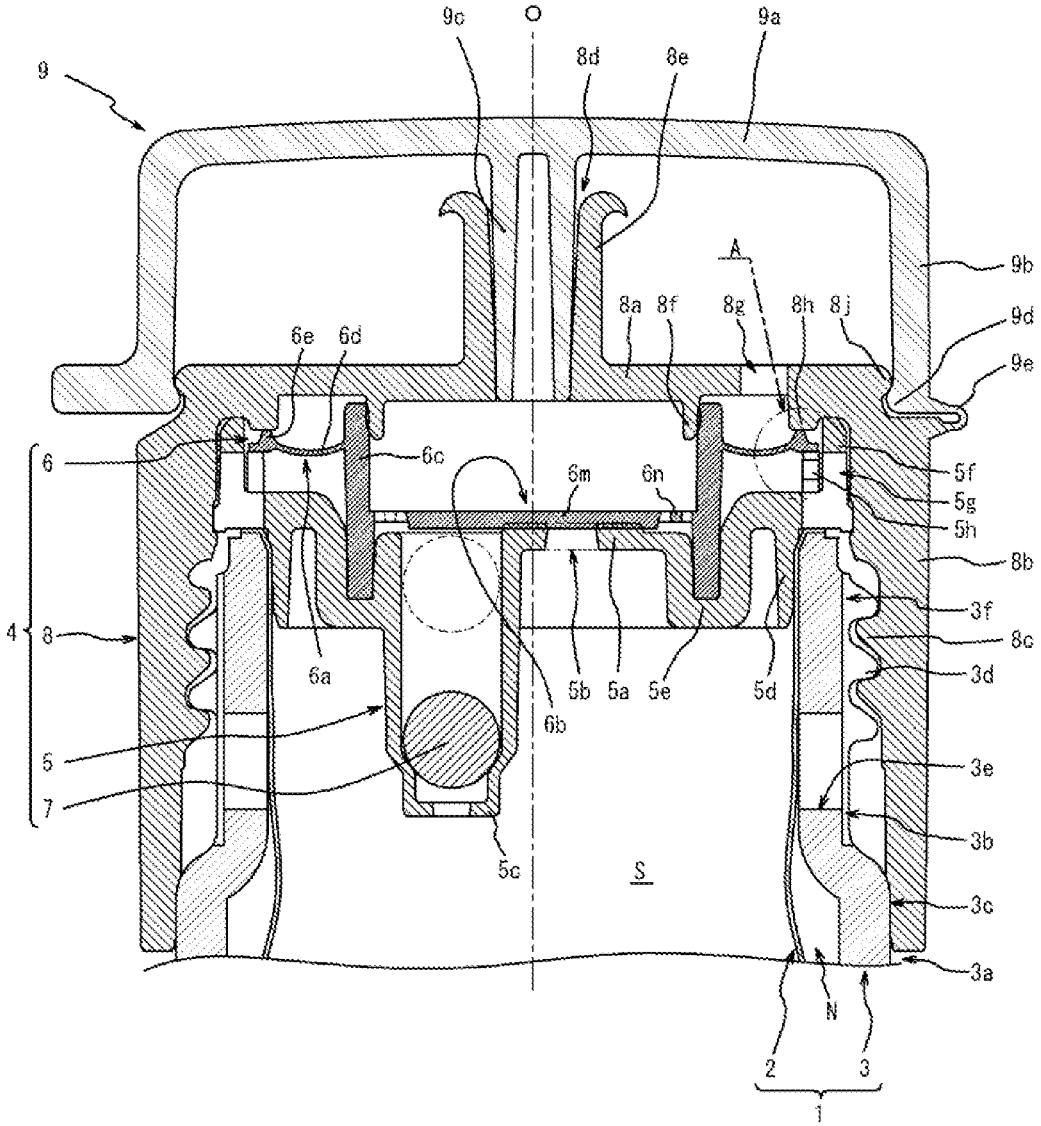
FIG. 1 is a partially enlarged cross-sectional view illustrating a first embodiment of a double container according to the present invention.

Hereinafter, a first embodiment of the double container according to the present invention will be described with reference to FIG. 1. In the present specification and the like, the "up" direction and the "down" direction are the directions of a state where the outer layer body (reference sign 3) is located below and the lid body (reference sign 9) is located above as illustrated in FIG. 1.

The double container of the present embodiment includes a container body 1 (including an inner layer body 2 and an outer layer body 3), a pouring cap 4 (including an inner plug 5, a check valve 6, a mobile valve 7, and a cap body 8), and a lid body 9.

The inner layer body 2 includes a filling space S inside that can accommodate the content liquid. The inner layer body 2 of the present embodiment is made of thin synthetic resin and can be reduced in volume and deformed.

The outer layer body 3 includes a tubular mouth part 3*a* extending along a central axis O. In the mouth part 3*a* of the present embodiment, a lower portion 3*c* is formed to have a larger diameter than an upper portion 3*b* having an open upper end. In addition, a male screw part 3*d* is provided on the outer peripheral surface of the upper portion 3*b*. Further, the upper portion 3*b* is provided with a vent 3*e* extending in the radial direction and penetrating the upper portion 3*b*, and the outer peripheral surface where the vent 3*e* opens is provided with a notch 3*f* extending in the vertical direction and divides the male screw part 3*d*. Although not illustrated, a tubular body part and a bottom part that closes the lower end of the body part are provided below the mouth part 3*a*, and the outer layer body 3 has a bottle-like shape. In addition, the outer layer body 3 of the present embodiment is made of synthetic resin, and the body part has flexibility.

In addition, an internal space N leading to the vent 3*e* is formed between the inner layer body 2 and the outer layer body 3.

The inner layer body 2 and the outer layer body 3 in the present embodiment are made by laminating synthetic resins having low compatibility with each other to be peelable. As synthetic resin forming the inner layer body 2, for example, nylon resin (PA), ethylene vinyl alcohol copolymer resin (EVOH), modified polyolefin resin (for example, "ADMER" (registered trademark) manufactured by Mitsui Chemicals Inc.), polyethylene terephthalate resin (PET), polyethylene resin (PE), and polypropylene resin (PP) can be used. As synthetic resin forming the outer layer body 3, for example, polyethylene resin (PE) such as low density polyethylene (LDPE) and high density polyethylene resin (HDPE), as well as polypropylene resin (PP) and polyethylene terephthalate resin (PET) can be used. The inner layer body 2 and the outer layer body 3 may be formed by a single synthetic resin to have a single layer structure, or may be formed by superimposing a plurality of synthetic resins to form a laminated structure. Such an inner layer body 2 and an outer layer body 3 can be obtained by blow molding a parison in which a synthetic resin material forming the inner layer body 2 and a synthetic resin material forming the outer layer body 3 are laminated. In addition, a test tubular preform in which the synthetic resin material of the inner layer body 2 and the synthetic resin material of the outer layer body 3 are laminated can be prepared, and this preform can be formed by biaxial stretch blow molding. It is also possible to form the inner layer body and the outer layer body individually, and then arrange the inner layer body is inside the outer layer body. Further, although not illustrated, one or a plurality of adhesive bands extending vertically to partially join the inner layer body 2 and the outer layer body 3 may be provided between the inner layer body 2 and the outer layer body 3.

The inner plug 5 is made of synthetic resin such as polypropylene (PP). The inner plug 5 of the present embodiment includes a partition wall 5*a* located above the mouth part 3*a* and closing the filling space S. The partition wall 5*a* is provided with an opening (a content liquid communication port 5*b*) penetrating the partition wall 5*a*, and a tubular wall 5*c* having a cylindrical shape as a whole and having the diameter of the lower part reduced with respect to the upper part.

In addition, an annular recess part 5*e* having an open upper portion is provided on the radial outer side of the content liquid communication port 5*b* and the tubular wall 5*c*, and an annular seal wall 5*d* that abuts on the inner layer body 2 in a liquid-tight way is provided on the lower surface of the partition wall 5*a* on the radial outer side of the annular recess part 5*e*. Further, the outer edge part of the partition wall 5*a* is provided with an outer edge wall 5*f* extending upward. A communication opening 5*g* is provided at the connecting part between the partition wall 5*a* and the outer edge wall 5*f*.

Figure 2:
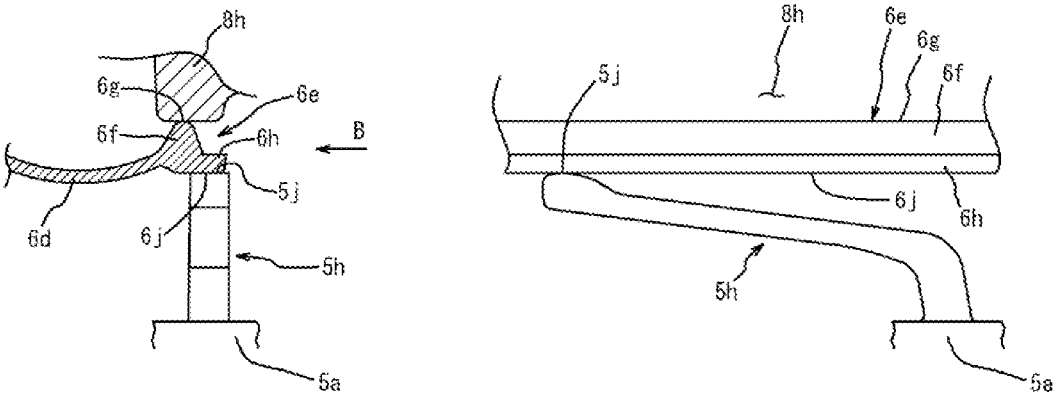
FIG. 2 is a diagram illustrating an air valve and a protrusion (regulation part) illustrated in FIG. 1.

Further, the inner plug 5 includes a protrusion (regulation part) 5*h* provided on the upper surface of the partition wall 5*a* on the radial inner side of the outer edge wall 5*f*. As illustrated in FIG. 2, the protrusion 5*h* has a root part connected to the partition wall 5*a*, extends diagonally upward from there at an angle close to vertical, and then extends diagonally upward at an angle close to horizontal to make roughly a Japanese letter "ku" shape (sideways L shape). In addition, the tip part of the protrusion 5*h* bulges upward, and a flat surface (a regulation part abutting surface 5*j*) is formed on the upper surface of the tip part. The upper surface of the tip part of the protrusion 5*h* may be a curved surface. In the present embodiment, a plurality of such protrusions 5*h* is provided at intervals in the circumferential direction with respect to the partition wall 5*a*.

The check valve 6 includes an air valve 6*a* for regulating the flow of air and a pouring valve 6*b* for regulating the flow of the content liquid. The check valve 6 of the present embodiment is made of a soft material such as rubber, elastomer, or soft polyethylene (low density polyethylene).

The air valve 6*a* includes a base part 6*c* that is cylindrical with the central axis O as the center and has a lower end part supported by the annular recess part 5*e*. In addition, the radial outer side of the base part 6*c* is provided with an air valve body part 6*d* that is a thin donut plate shape with the central axis O as the center, and has an inner edge part integrally connected to the base part 6*c* and fixedly supported by the base part 6*c* and extends downward in a curved shape from there toward the radial outer side (extends in an arc shape) as illustrated in FIG. 1 is provided. Further, as illustrated in FIG. 2, an air valve outer edge part 6*e* having a thickness thicker than that of the air valve body part 6*d* is provided on the outer edge side of the air valve body part 6*d*.

Figure 3:
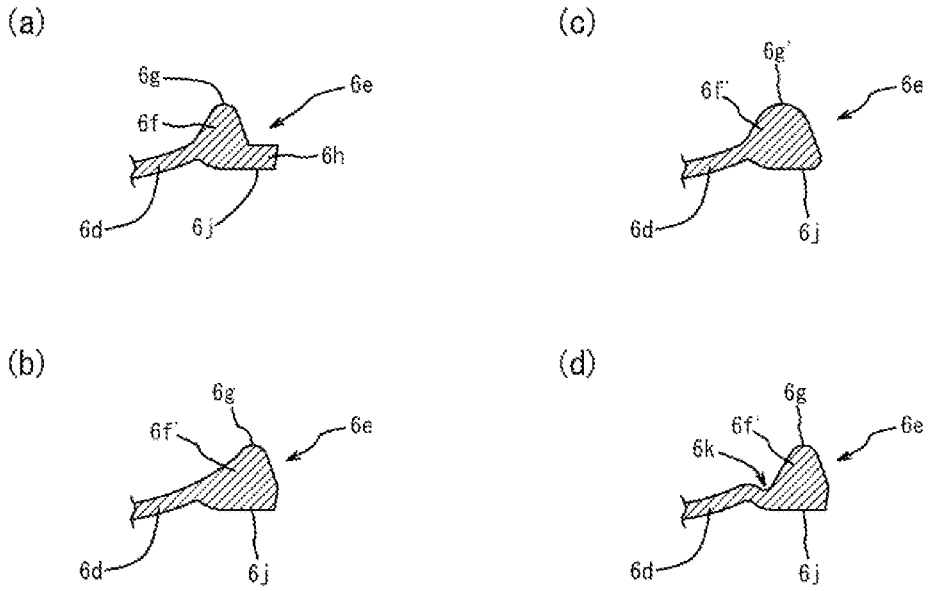
FIG. 3 is a diagram illustrating a modified example of an air valve outer edge part provided in the air valve.

FIG. 3(*a*) is a diagram illustrating the air valve outer edge part 6*e* of the present embodiment in more detail. An upper part 6*f* of the air valve outer edge part 6*e* of the present embodiment protrudes upward to taper, the top part becomes an arc-shaped surface in a cross-sectional view (note that this arc-shaped surface is referred to as a second abutting surface 6*g*), and the outer edge part of the upper part 6*f* is provided with an outer end part 6*h* extending in the radial outer side. In addition, a flat surface (first abutting surface 6*j*) is provided on the lower surface of the upper part 6*f* and the outer end part 6*h*. As illustrated in FIG. 2, the first abutting surface 6*j* is a portion where the regulation part abutting surface 5*j* of the protrusion 5*h* abuts.

By the way, the shape of the air valve outer edge part 6*e* can be changed in various ways, for example, as an upper part 6*f'* in which the upper part 6*f* and the outer end part 6*h* are integrally formed, as illustrated in FIGS. 3(*b*) to 3(*d*). Here, in the upper part 6*f'* of FIG. 3(*b*), the surface on the inner edge side connected to the air valve body part 6*d* is an arc-shaped surface similar to the air valve body part 6*d*. In addition, in the upper part 6*f'* of FIG. 3(*c*), the surface on the outer edge side is located on the radial outer side than the upper part 6*f* of FIG. 3(*a*), and includes a second abutting surface 6*g'* with a curvature smaller than that of the second abutting surface 6*g* of FIG. 3(*a*). In addition, the upper part 6*f'* in FIG. 3(*d*) includes a depression 6*k* between the air valve body part 6*d* and the upper part 6*f'*.

As illustrated in FIG. 1, the pouring valve 6*b* is located above the content liquid communication port 5*b* and the tubular wall 5*c*, and sits on the partition wall 5*a* to close the content liquid communication port 5*b*. On the other hand, the pouring valve 6*b* includes a plate-shaped pouring valve main body part 6*m* that leaves a part of the tubular wall 5*c* released and a connecting piece 6*n* that elastically connects the pouring valve main body part 6*m* and the base part 6*c*. The pouring valve 6*b* is not limited to connecting the pouring valve main body part 6*m* and the base part 6*c* with a plurality of connecting pieces 6*n* such as a three-point valve or a four-point valve, and may be connecting the pouring valve main body part 6*m* and the base part 6*c* with a single connecting piece 6*n* such as an one-point valve.

The mobile valve 7 has a spherical shape in the present embodiment, is arranged in the tubular wall 5*c*, and moves along the inner peripheral surface of the tubular wall 5*c* in response to a change in the posture of the container body 1 or the internal pressure of the filling space S. As illustrated in FIG. 1, the mobile valve 7 sits on the reduced diameter lower part of the tubular wall 5*c* in a state where the container body 1 is in the upright posture, and keeps the tubular wall 5*c* and the filling space S in a non-connected state.

In the present embodiment, the cap body 8 is made of synthetic resin, and includes a ceiling wall 8*a* located above the check valve 6 and an outer peripheral wall 8*b* integrally connected to the outer edge of the ceiling wall 8*a* and surrounding the mouth part 3*a*. On the inner peripheral surface of the outer peripheral wall 8*b*, a female screw part 8*c* suitable for the male screw part 3*d* is provided.

The center of the ceiling wall 8*a* is provided with a pouring cylinder 8*e* that extends upward from the edge part of the hole penetrating the ceiling wall 8*a* and of which the upper part opening is a pouring outlet 8*d* of the content liquid. On the lower surface of the ceiling wall 8*a*, an annular wall 8*f* that abuts on the inner peripheral surface of the base part 6*c* in a liquid-tight way is provided. On the radial outer side of the annular wall 8*f*, an outside air inlet 8*g* that penetrates the ceiling wall 8*a* in the vertical direction is provided. The radial outer side of the outside air inlet 8*g* is provided with an annular step part 8*h* that protrudes downward from the ceiling wall 8*a* and has a flat lower surface. The step part 8*h* of the present embodiment is a portion where the air valve outer edge part 6*e* of the air valve 6*a* abuts. More specifically, as illustrated in FIG. 2, the second abutting surface 6*g* abuts on the lower surface of the step part 8*h* in a state where the regulation part abutting surface 5*j* of the protrusion 5*h* abuts on the first abutting surface 6*j*. In addition, a claw part 8*j* for holding the lid body 9 is provided on the outer edge part of the ceiling wall 8*a*.

As will be described later, when the internal space N is in a decompressed state, regarding the air valve body part 6*d* of the air valve 6*a*, the periphery of a portion where the regulation part abutting surface 5*j* of the protrusion 5*h* abuts on the first abutting surface 6*j* almost does not move, and in this portion, the second abutting surface 6*g* abuts on the step part 8*h*. However, in a portion where the protrusion 5*h* does not abut, the air valve body part 6*d* bends downward. Therefore, a gap is formed between the second abutting surface 6*g* and the step part 8*h*. In this state, a passage (communication passage) through which air flows, communicating from the outside air inlet 8*g* to the vent 3*e* is formed inside the cap body 8. The communication passage of the present embodiment is a passage that passes through the outside air inlet 8*g*, passes through the gap between the separated second abutting surface 6*g* and the step part 8*h*, and leads to the vent 3*e* via the communication opening 5*g* and further a spiral gap formed between the male screw part 3*d* and the female screw part 8*c* (a gap due to the notch 3*f*). Since the air valve body part 6*d* of the present embodiment is thinner than the air valve outer edge part 6*e* and is easily bent. Therefore, when the internal space N is in a decompressed state, the second abutting surface 6*g* can surely be separated from the step part 8*h*.

The lid body 9 is made of synthetic resin in the present embodiment, and includes a top wall 9*a* located above the ceiling wall 8*a* and a lid body outer peripheral wall 9*b* integrally connected to the top wall 9*a*. The lower surface of the top wall 9*a* is provided with a seal tube 9*c* that is inserted inside the pouring cylinder 8*e* and abuts on the inner surface of the pouring cylinder 8*e* in an airtight way. The inner peripheral surface of the lid body outer peripheral wall 9*b* is provided with an engagement convex part 9*d* that engages with the claw part 8*j*. In addition, the outer peripheral surface of the lid body outer peripheral wall 9*b* is provided with a hinge part 9*e* that is integrally connected to the outer peripheral wall 8*b* of the cap body 8. Although the lid body 9 of the present embodiment is integrally connected to the cap body 8, the lid body 9 may be provided separately from the cap body 8 and detachably attached to the cap body 8 by a screw or an undercut.

In the double container having such a configuration, the internal space N is pressurized by pressing the body part of the outer layer body 3, which increases the pressure in the filling space S. Therefore, the content liquid of the filling space S raises the pouring valve main body part 6*m*, flows from the content liquid communication port 5*b* through the gap around the connecting piece 6*n* to the inside of the base part 6*c*, and is poured out through the inside of the pouring cylinder 8*e* from the pouring outlet 8*d*. Here, regarding the above-mentioned communication passage connecting the vent 3*e* and the outside air inlet 8*g*, the air valve outer edge part 6*e* of the air valve 6*a* abuts on the step part 8*h* over the entire circumference and is in a non-communication state. Therefore, the air in the internal space N does not leak to the outside world. The mobile valve 7 in the tubular wall 5*c* moves to the side of the pouring valve main body part 6*m* (position illustrated by the broken line in FIG. 1) by its own weight or the content liquid flowing in from the opening on the lower side of the tubular wall 5*c* in a state where the container body 1 is displaced to a tilted posture in a manner that the content liquid can be poured out.

After that, when the pressure on the outer layer body 3 is released and the body part begins to be restored, the volume of the internal space N increases, in a manner that the internal space N is in a decompressed state. As a result, regarding the air valve 6*a*, the air valve body part 6*d* bends downward at the portion where the protrusion 5*h* does not abut. Therefore, a gap is formed between the second abutting surface 6*g* and the step part 8*h*, and air introduced from the outside air inlet 8*g* is introduced through the above-mentioned communication passage to the internal space N. As a result, the outer layer body 3 can be restored while the inner layer body 2 is reduced in volume and deformed. By the way, in this state, since the regulation part abutting surface 5*j* of the protrusion 5*h* abuts on the first abutting surface 6*j*, the vibration of the air valve 6*a* can be suppressed and the noise can be suppressed. The regulation part abutting surface 5*j* may be a curved surface, but when both the regulation part abutting surface 5*j* and the first abutting surface 6*j* are flat surfaces as in the present embodiment, both abuts on more stably. Therefore, it is possible to more surely suppress the noise.

When the pressure on the outer layer body 3 is released, the pressure in the filling space S returns to the original state and the pouring valve main body part 6*m* sits on the upper surface of the partition wall 5*a*. Therefore, it is possible to prevent the inflow of outside air from the content liquid communication port 5*b* into the filling space S. Here, when the container body 1 is displaced to the original upright posture after the pouring of the content liquid is completed, the mobile valve 7 moves downward due to its own weight or the pressure drop in the filling space S. As a result, a space corresponding to the movement of the mobile valve 7 is formed on the upper inner side of the tubular wall 5*c*. Therefore, the content liquid corresponding to this space can be pulled back from the pouring cylinder 8*e* to the inside of the tubular wall 5*c* (suckback function), and it is possible to effectively prevent dripping from the pouring cylinder 8*e*. Since the mobile valve 7 that has moved downward sits on the reduced diameter lower part of the tubular wall 5*c*, it is possible to prevent the inflow of outside air from the tubular wall 5*c* into the filling space S.

Hereinafter, a second embodiment of the double container according to the present invention will be described with reference to FIGS. 4 to 7. In the following description, the same portions as those in the first embodiment described above are designated by the same reference signs in the drawings, and detailed description will be omitted.

The double container of the present embodiment includes the container body 1 (including the inner layer body 2 and the outer layer body 3), a pouring cap 14 (including an inner plug 15, a check valve 16, the mobile valve 7, and a cap body 18), and a lid body 19.

The inner plug 15 is made of synthetic resin such as polypropylene (PP). The inner plug 15 of the present embodiment is provided with a partition wall 15*a* that is located above the mouth part 3*a* and closes the filling space S, and the partition wall 15*a* includes an opening (a content liquid communication port 15*b*) penetrating the partition wall 15*a*, and a tubular wall 15*c* having a cylindrical shape as a whole and having the diameter of the lower part reduced with respect to the upper part.

In addition, an annular recess part 15*e* having an open upper portion is provided on the radial outer side of the content liquid communication port 15*b* and the tubular wall 15*c*, and an annular seal wall 15*d* that abuts on the inner layer body 2 in a liquid-tight way is provided on the lower surface of the partition wall 15*a* on the radial outer side of the annular recess part 15*e*. Further, the outer edge part of the partition wall 15*a* is provided with an annular wall 15*f* that stands up upward. At a portion where the partition wall 15*a* and the annular wall 15*f* are connected, the radial outer portion of the partition wall 15*a* and the lower portion of the annular wall 15*f* are integrally cut out and formed, and an air communication port 15*g* that penetrates both the partition wall 15*a* and the annular wall 15*f* is provided.

Figure 5:
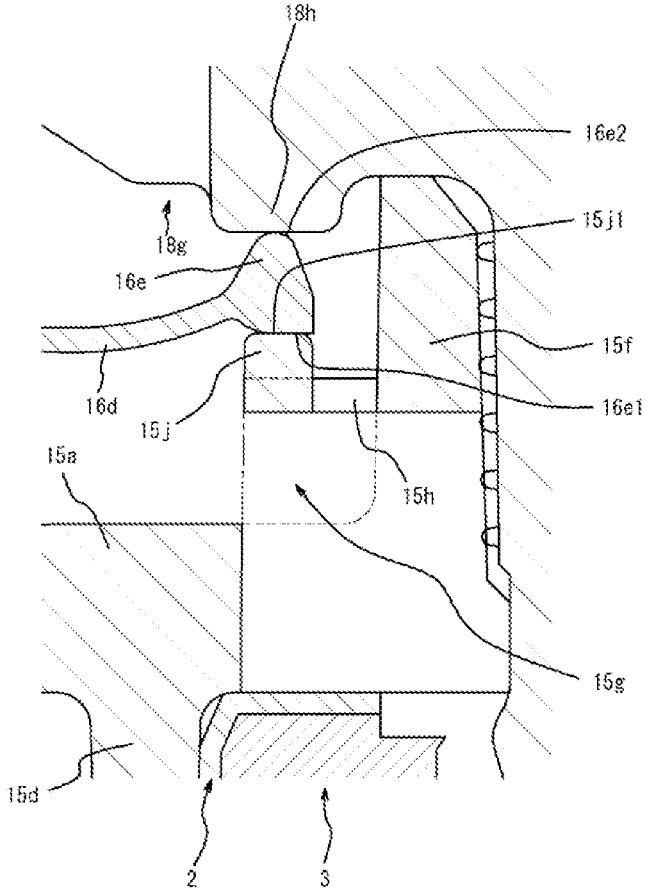
FIG. 5 is an enlarged view of a periphery of a plate-shaped part in FIG. 4.
Figure 6:
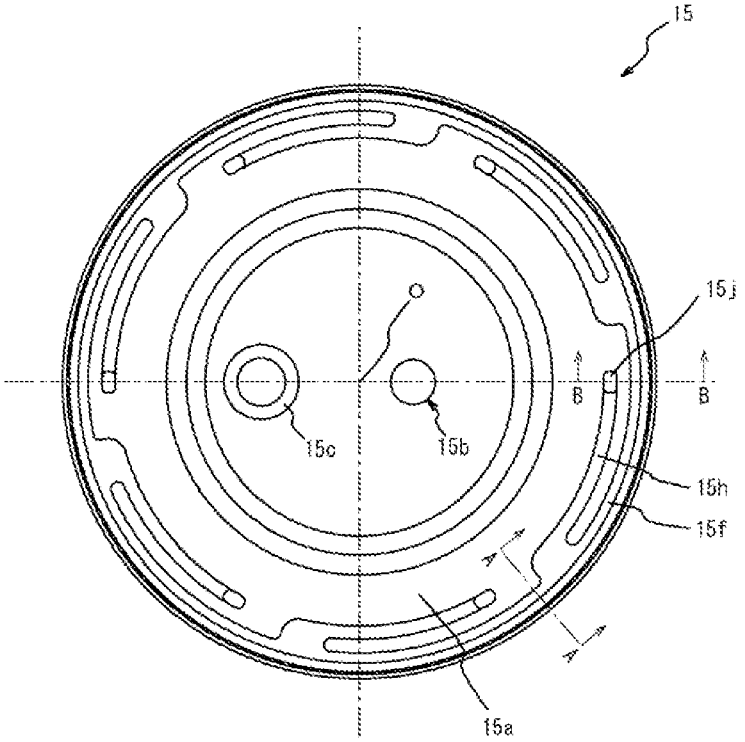
FIG. 6 is a plan view of an inner plug illustrated in FIG. 4.

Further, the inner plug 15 is integrally connected to the inner peripheral surface of the annular wall 15*f*, and includes a plate-shaped part 15*h* having a relatively thin thickness. As illustrated in FIG. 5, the plate-shaped part 15*h* is provided to be located directly above the air communication port 15*g*. In addition, the lower surface of the plate-shaped part 15*h* is located at a height aligned with the lower surface of the annular wall 15*f* that partitions the air communication port 15*g*. As illustrated in FIG. 6, the plate-shaped part 15*h* of the present embodiment has a form extending toward the radial inner side with a relatively wide width from the inner peripheral surface of the annular wall 15*f* and then extending in an arc shape with a relatively narrow width along the annular wall 15*f* in a plan view. Since the plate-shaped part 15*h* is relatively thin and extends long in a plan view, the plate-shaped part 15*h* can be elastically deformed in the vertical direction like a cantilever. In the present embodiment, a total of six plate-shaped parts 15*h* having such a form is provided at equal intervals in the circumferential direction with respect to the annular wall 15*f*. The number of plate-shaped parts 15*h* can be arbitrarily changed depending on the shape of the inner plug 15 and the intended function. In addition, the tip of each plate-shaped part 15*h* is provided with an abutting part 15*j* that projects upward and abuts on the lower surface of the air valve (sign 16*a*) as described later. Here, in the present specification and the like, the plate-shaped part 15*h* and the abutting part 15*j* are collectively referred to as a "regulation part". The upper surface of the abutting part 15*j* (a regulation part abutting surface 15*j*1) is a flat surface extending in a substantially horizontal direction as illustrated in FIG. 5.

Figure 7:
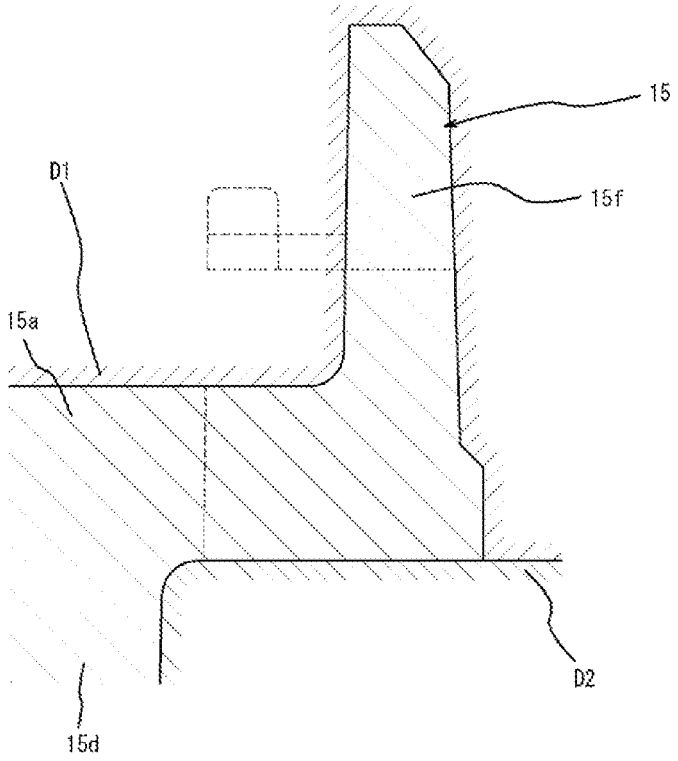
FIG. 7 is a diagram illustrating a mold for forming the inner plug illustrated in FIG. 4.
Figure 7:
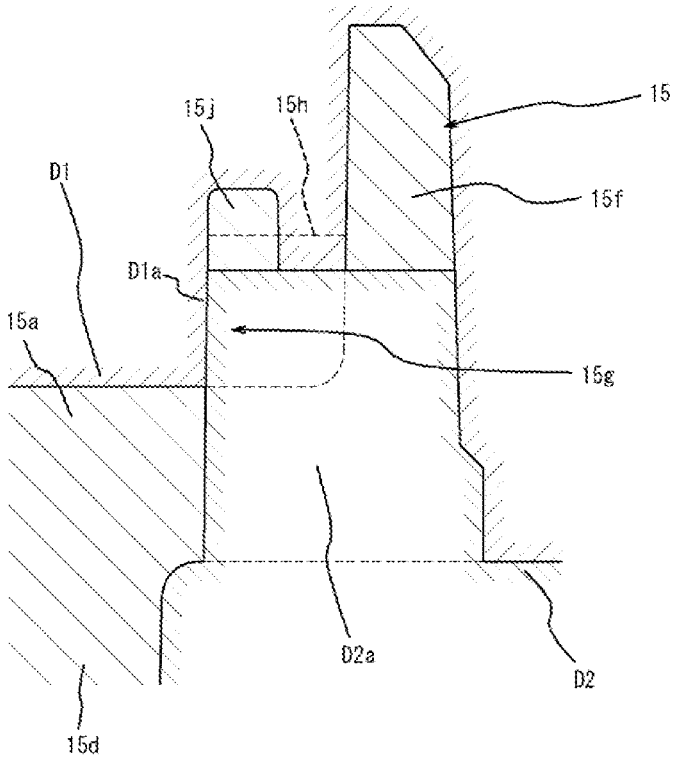

The inner plug 15 of the present embodiment is formed into the above-mentioned form by curing the molten synthetic resin material in a mold. Specifically, as illustrated in FIG. 7, an upper mold D1 for forming the shape on the upper surface of the inner plug 15 and a lower mold D2 for forming the shape on the lower surface of the inner plug 15 are abutted against each other and the molds are closed. A synthetic resin material is cured in the cavity formed inside these molds to form the inner plug 15. FIG. 7 is a schematic view illustrating the vicinity of the connection part between the partition wall 15*a* and the annular wall 15*f* in the upper mold D1 and the lower mold D2. FIG. 7(*a*) illustrates a cross-sectional view (cross-sectional view along A-A illustrated in FIG. 6) of a portion where the air communication port 15*g* and the plate-shaped part 15*h* are not provided, and FIG. 7(*b*) illustrates a cross-sectional view (cross-sectional view along B-B illustrated in FIG. 6) of a portion where the air communication port 15*g* and the plate-shaped part 15*h* are provided.

As illustrated in FIG. 7(*a*), the upper mold D1 forms the upper surface of the partition wall 15*a*, the inner peripheral surface, the upper surface, and the outer peripheral surface of the annular wall 15*f*, and the like and the lower mold D2 forms the lower surface of the partition wall 15*a*, the outer peripheral surface of the seal wall 15*d*, and the like. In addition, as illustrated in FIG. 7(*b*), in a portion where the air communication port 15*g* and the plate-shaped part 15*h* are provided, the lower mold D2 is provided with a protrusion part D2*a* that partially protrudes upward, and the upper mold D1 is provided with a recess part D1*a* having a shape corresponding to the protrusion part D2*a*. Then, the radial inner surface of the recess part D1*a* and the radial outer surface of the protrusion part D2*a* are directly abutted to be engaged with each other, and the air communication port 15*g* is opened.

By the way, the lower surface of the annular wall 15*f* and the lower surface of the plate-shaped part 15*h* are formed by the upper surface of the protrusion part D2*a*. Here, if the lower surface of the annular wall 15*f* and the lower surface of the plate-shaped part 15*h* are not aligned (if the lower surface of the plate-shaped part 15*h* is located above or below the lower surface of the annular wall 15*f*), the shape of the upper surface of the protrusion part D2*a* becomes complicated, the cost increases, and molding becomes difficult. On the other hand, by aligning the lower surface of the annular wall 15*f* with the lower surface of the plate-shaped part 15*h* as in the present embodiment, the mold cost can be suppressed and the molding can be stably performed.

Figure 4:
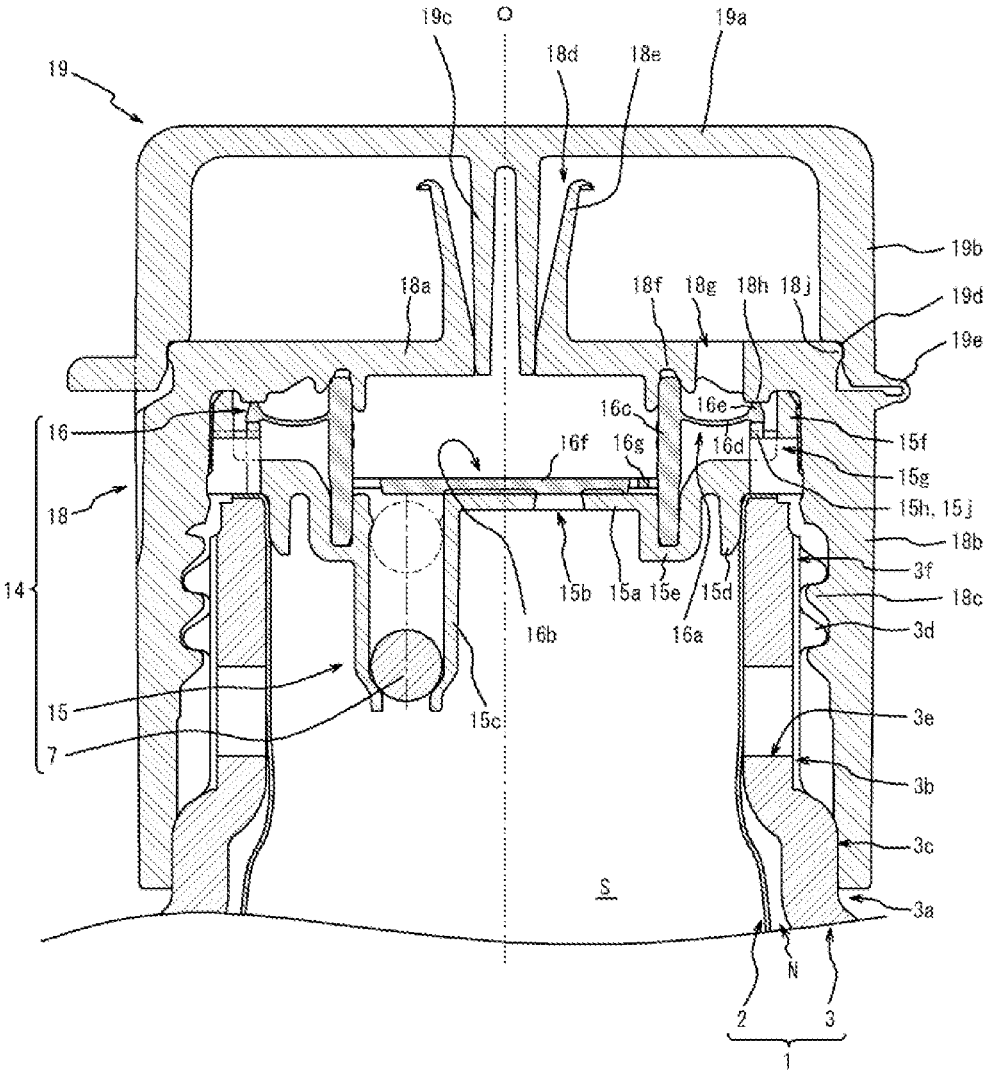
FIG. 4 is a partially enlarged cross-sectional view illustrating a second embodiment of the double container according to the present invention in a side view.

As illustrated in FIG. 4, the check valve 16 includes an air valve 16*a* for regulating the flow of air and a pouring valve 16*b* for regulating the flow of the content liquid. The check valve 16 of the present embodiment is made of a soft material such as rubber, elastomer, or soft polyethylene (low density polyethylene).

The air valve 16*a* includes a base part 16*c* that is cylindrical with the central axis O as the center and has a lower end part supported by the annular recess part 15*e*. In addition, the radial outer side of the base part 16*c* is provided with an air valve body part 16*d* that is a thin donut plate shape with the central axis O as the center, and has an inner edge part integrally connected to the base part 16*c* and fixedly supported by the base part 16*c* and extends downward in a curved shape from there toward the radial outer side (extends in an arc shape) as illustrated in FIG. 4 is provided. Further, an air valve outer edge part 16*e* having a thickness thicker than that of the air valve body part 16*d* is provided on the outer edge side of the air valve body part 16*d*.

As illustrated in FIG. 5, the upper surface (second abutting surface 16*e*2) of the air valve outer edge part 16*e* the present embodiment is inclined to taper upward, and the top part is an arc-shaped surface in a cross-sectional view. In addition, the lower surface (first abutting surface 16*e*1) of the air valve outer edge part 16*e* is a flat surface extending in a substantially horizontal direction. Right below the air valve outer edge part 16*e*, a plate-shaped part 15*h* separated from the lower surface of the air valve outer edge part 16*e* extends along the air valve outer edge part 16*e* (extends in an arc shape as illustrated in FIG. 6). In addition, regarding the abutting part 15*j* provided at the tip of the plate-shaped part 15*h*, the upper surface (regulation part abutting surface 15*j*1) abuts on the lower surface (first abutting surface 16*e*1) of the air valve outer edge part 16*e*.

As illustrated in FIG. 4, the pouring valve 16*b* is located above the content liquid communication port 15*b* and the tubular wall 15*c*, and sits on the partition wall 15*a* to close the content liquid communication port 15*b*. On the other hand, the pouring valve 16*b* includes a plate-shaped pouring valve main body part 16*f* that leaves a part of the tubular wall 15*c* released and a connecting piece 16*g* that elastically connects the pouring valve main body part 16*f* and the base part 16*c*. The pouring valve 16*b* is not limited to connecting the pouring valve main body part 16*f* and the base part 16*c* with a plurality of connecting pieces 16*g* such as a three-point valve or a four-point valve, and may be connecting the pouring valve main body part 16*f* and the base part 16*c* with a single connecting piece 16*g* such as an one-point valve.

Like the cap body 8 described above, the cap body 18 is made of synthetic resin, and includes a ceiling wall 18*a* located above the check valve 16 and an outer peripheral wall 18*b* integrally connected to the outer edge of the ceiling wall 18*a* and surrounding the mouth part 3*a*. On the inner peripheral surface of the outer peripheral wall 18*b*, a female screw part 18*c* suitable for the male screw part 3*d* is provided.

The center of the ceiling wall 18*a* is provided with a pouring cylinder 18*e* that extends upward from the edge part of the hole penetrating the ceiling wall 18*a* and of which the upper part opening is a pouring outlet 18*d* of the content liquid. The lower surface of the ceiling wall 18*a* is provided with an annular recess part 18*f* that opens downward and supports the upper part of the base part 16*c*. On the radial outer side of the annular recess part 18*f*, an outside air inlet 18*g* that penetrates the ceiling wall 18*a* in the vertical direction is provided. The radial outer side of the outside air inlet 18*g* is provided with an annular step part 18*h* that protrudes downward from the ceiling wall 18*a* and has a flat lower surface. The step part 18*h* of the present embodiment is a portion where the air valve outer edge part 16*e* of the air valve 16*a* abuts. More specifically, as illustrated in FIG. 5, the upper surface of the air valve outer edge part 6*e* (second abutting surface 16*e*2) abuts on the lower surface of the step part 8*h* in a state where the upper surface of the abutting part 15*j* (regulation part abutting surface 15*j*1) abuts on the lower surface of the air valve outer edge part 16*e* (first abutting surface 16*e*1). In addition, as illustrated in FIG. 4, a claw part 18*j* for holding the lid body 19 is provided on the outer edge part of the ceiling wall 18*a*.

As will be described later, when the internal space N is in a decompressed state, the air valve body part 16*d* of the air valve 16*a* bends downward, and a gap through which air can flow is formed between the air valve outer edge part 16*e* and the step part 18*h*. In this state, a passage (communication passage) through which air flows, communicating from the outside air inlet 18*g* to the vent 3*e* is formed inside the cap body 18. The communication passage of the present embodiment is a passage that passes through the outside air inlet 18*g*, passes through the gap between the separated air valve outer edge part 16*e* and the step part 18*h*, and leads to the vent 3*e* via the air communication port 15*g* and further a spiral gap formed between the male screw part 3*d* and the female screw part 18*c* (a gap due to the notch 3*f*). Since the air valve body part 16*d* of the present embodiment is thinner than the air valve outer edge part 16*e* and is easily bent. Therefore, when the internal space N is in a decompressed state, the air valve outer edge part 16*e* can surely be separated from the step part 18*h*. Further, since the plate-shaped part 15*h* can be elastically deformed in the vertical direction as described above, the air valve outer edge part 16*e* does not significantly hinder the separation from the step part 18*h*.

Like the lid body 9 described above, the lid body 19 is made of synthetic resin, and includes a top wall 19*a* located above the ceiling wall 18*a* and a lid body outer peripheral wall 19*b* integrally connected to the top wall 19*a*. The lower surface of the top wall 19*a* is provided with a seal tube 19*c* that is inserted inside the pouring cylinder 18*e* and abuts on the inner surface of the pouring cylinder 18*e* in an airtight way. The inner peripheral surface of the lid body outer peripheral wall 19*b* is provided with an engagement convex part 19*d* that engages with the claw part 18*j*. In addition, the outer peripheral surface of the lid body outer peripheral wall 19*b* is provided with a hinge part 19*e* that is integrally connected to the outer peripheral wall 18*b* of the cap body 18. Although the lid body 19 of the present embodiment is integrally connected to the cap body 18, the lid body 19 may be provided separately from the cap body 18 and detachably attached to the cap body 18 by a screw or an undercut.

In such a double container of the second embodiment, the internal space N is pressurized by pressing the body part of the outer layer body 3, which increases the pressure in the filling space S. Therefore, the content liquid of the filling space S raises the pouring valve main body part 16*f*, flows from the content liquid communication port 15*b* through the gap around the connecting piece 16*g* to the inside of the base part 16*c*, and is poured out through the inside of the pouring cylinder 18*e* from the pouring outlet 18*d*. Here, regarding the above-mentioned communication passage connecting the vent 3*e* and the outside air inlet 18*g*, the air valve outer edge part 16*e* of the air valve 16*a* abuts on the step part 18*h* over the entire circumference and is in a non-communication state. Therefore, the air in the internal space N does not leak to the outside world. Further, in the present embodiment, the air valve outer edge part 16*e* is supported from below by the abutting part 15*j* provided at the tip of the plate-shaped part 15*h*, in a manner that the contact between the air valve outer edge part 16*e* and the step part 18*h* is more reliable. Therefore, it is will be possible to more surely prevent the problem that the air in the internal space N leaks to the outside world. The upper surface of the abutting part 15*j* (regulation part abutting surface 15*j*1) and the lower surface of the air valve outer edge part 16*e* (first abutting surface 16*e*1) may be a curved surface. However, when both are flat surfaces as in the present embodiment, since both abuts on with each other more stably, it is possible to more surely prevent the problem that the air in the internal space N leaks to the outside world. Then, the mobile valve 7 in the tubular wall 15*c* moves to the side of the pouring valve main body part 16*f* (position illustrated by the broken line in FIG. 4) by its own weight or the content liquid flowing in from the opening on the lower side of the tubular wall 15*c* in a state where the container body 1 is displaced to a tilted posture in a manner that the content liquid can be poured out.

After that, when the pressure on the outer layer body 3 is released and the body part begins to be restored, the volume of the internal space N increases, in a manner that the internal space N is in a decompressed state. As a result, the air valve body part 16*d* bends downward while elastically deforming the plate-shaped part 15*h*. Therefore, a gap is formed between the air valve outer edge part 16*e* and the step part 18*h*, and air introduced from the outside air inlet 18*g* is introduced through the above-mentioned communication passage to the internal space N. As a result, the outer layer body 3 can be restored while the inner layer body 2 is reduced in volume and deformed. In addition, in this state, since the upper surface of the abutting part 15*j* (regulation part abutting surface 15*j*1) abuts on the lower surface of the air valve outer edge part 16*e* (first abutting surface 16*e*1), the vibration of the air valve 16*a* can be suppressed and the noise can be suppressed. In particular, in the present embodiment, the upper surface of the abutting part 15*j* (regulation part abutting surface 15*j*1) and the lower surface of the air valve outer edge part 6*e* (first abutting surface 16*e*1) are both flat surfaces, and both are stably abutted. Therefore, the vibration of the air valve 16*a* can be suppressed more surely, in a manner that the effect of suppressing noise is further ensured.

When the pressure on the outer layer body 3 is released, the pressure in the filling space S returns to the original state and the pouring valve main body part 16*f* sits on the upper surface of the partition wall 15*a*. Therefore, it is possible to prevent the inflow of outside air from the content liquid communication port 15*b* into the filling space S. Here, when the container body 1 is displaced to the original upright posture after the pouring of the content liquid is completed, the mobile valve 7 moves downward due to its own weight or the pressure drop in the filling space S. As a result, a space corresponding to the movement of the mobile valve 7 is formed on the upper inner side of the tubular wall 15*c*. Therefore, the content liquid corresponding to this space can be pulled back from the pouring cylinder 18*e* to the inside of the tubular wall 15*c* (suckback function), and it is possible to effectively prevent dripping from the pouring cylinder

18*e*. Since the mobile valve 7 that has moved downward sits on the reduced diameter lower part of the tubular wall 15*c*, it is possible to prevent the inflow of outside air from the tubular wall 15*c* into the filling space S.

Although one embodiment of the present invention has been described above, the present invention is not limited to such a specific embodiment, and unless otherwise specified in the above description, various modifications and changes are possible within the range of the gist of the present invention described in the claims. Moreover, the effect of the above-described embodiment is merely an example of the effect resulting from the present invention, and does not mean that the effect of the present invention is limited to the above-mentioned effect.

For example, the protrusion 5*h* (regulation part) described above hardly bends when a downward force is applied to the tip part, but may bend downward when the second abutting surface 6*g* separates from the step part 8*h* by reducing the thickness or forming the protrusion 5*h* with a soft material (such as rubber and elastomer) by insert molding and the like. In addition, the second abutting surfaces 6*g* and 16*e*2 may abut on the lower surfaces of the ceiling walls 8*a* and 18*a* without providing the step parts 8*h* and 18*h*.

REFERENCE SIGNS LIST

1 Container body
2 Inner layer body
3 Outer layer body
3*a* Mouth part
3*b* Upper portion
3*c* Lower portion
3*d* Male screw part
3*e* Vent
3*f* Notch
4 Pouring cap
5 Inner plug
5*a* Partition wall
5*b* Content liquid communication port
5*c* Tubular wall
5*d* Seal wall
5*e* Annular recess part
5*f* Outer edge wall
5*g* Communication opening
5*h* Protrusion (regulation part)
5*j* Regulation part abutting surface
6 Check valve
6*a* Air valve
6*b* Pouring valve
6*c* Base part
6*d* Air valve body part
6*e* Air valve outer edge part
6*f*, 6*f*' Upper part
6*g*, 6*g*' Second abutting surface
6*h* Outer end part
6*j* First abutting surface
6*k* Depression
6*m* Pouring valve main body part
6*n* Connecting piece
7 Mobile valve
8 Cap body
8*a* Ceiling wall
8*b* Peripheral wall
8*c* Female screw part
8*d* Pouring outlet
8*e* Pouring cylinder
8*f* Annular wall
8*g* Outside air inlet
8*h* Step part
8*j* Claw part
9 Lid body
9*a* Top wall
9*b* Lid body outer peripheral wall
9*c* Seal tube
9*d* Engagement convex part
9*e* Hinge part
14 Pouring cap
15 Inner plug
15*a* Partition wall
15*b* Content liquid communication port
15*c* Tubular wall
15*d* Seal wall
15*e* Annular recess part
15*f* Annular wall
15*g* Air communication port
15*h* Plate-shaped part (regulation part)
15*j* Abutting part (regulation part)
15*j*1 Regulation part abutting surface
16 Check valve
16*a* Air valve
16*b* Pouring valve
16*c* Base part
16*d* Air valve body part
16*e* Air valve outer edge part
16*e*1 First abutting surface
16*e*2 Second abutting surface
16*f* Pouring valve main body part
16*g* Connecting piece
18 Cap body
18*a* Ceiling wall
18*b* Peripheral wall
18*c* Female screw part
18*d* Pouring outlet
18*e* Pouring cylinder
18*f* Annular recess part
18*g* Outside air inlet
18*h* Step part
18*j* Claw part
19 Lid body
19*a* Top wall
19*b* Lid body outer peripheral wall
19*c* Seal tube
19*d* Engagement convex part
19*e* Hinge part
D1 Upper mold
D1*a* Recess part
D2 Lower mold
D2*a* Protrusion part
N Internal space
O Central axis
S Filling space

The invention claimed is:

1. A double container pouring cap attached to a container body including an inner layer body having a filling space that accommodates content liquid and an outer layer body partitioning an inner space between the inner layer body and the outer layer body and including a vent that leads to the internal space, and pours out the content liquid in the filling space by pressing the outer layer body from a pouring outlet, the double container pouring cap comprising:

a cap body covering the vent and attached to the outer layer body, and including the pouring outlet and an outside air inlet that leads to the vent;

an air valve that can abut on and separate from a back surface of the cap body, and blocks air flow from the vent to the outside air inlet, while allowing air flow from the outside air inlet to the vent; and an inner plug provided to face the back surface of the cap body with the air valve interposed between, and including a regulation part that abuts on a part of the air valve and limits separation of the air valve from the back surface of the cap body, wherein a first abutting surface of the air valve where the regulation part abuts is a flat surface, the air valve includes a tubular base part, a donut plate-shaped and elastically deformable air valve body part having an inner edge fixedly supported by the base part, and an air valve outer edge part provided on an outer edge side of the air valve body part and having the first abutting surface on a side that faces the regulation part and a second abutting surface that abuts on the back surface of the cap body on a side that faces the back surface of the cap body, the air valve outer edge part includes an upper portion projecting upward and an outer end portion, wherein the outer end portion is provided on an outer edge of the upper portion and extends radially outwardly, wherein a lower surface of the outer end portion is a flat surface, the first abutting surface includes the lower surface of the outer end portion, the second abutting surface is the top of the upper portion, and at least a portion of the first abutting surface is in contact with the regulation part radially outside of the second abutting surface.

2. The double container pouring cap according to claim 1, wherein the air valve body part is thinner than the air valve outer edge part.

3. The double container pouring cap according to claim 2, wherein the regulation part is a protrusion having a root part connected to the inner plug and a tip part abutting on the first abutting surface.

4. The double container pouring cap according to claim 1, wherein the regulation part is a protrusion having a root part connected to the inner plug and a tip part abutting on the first abutting surface.

5. The double container pouring cap according to claim 1, wherein the first abutting surface and a regulation part abutting surface where the regulation part abuts on the first abutting surface are both flat surfaces.

6. A double container comprising the container body and the double container pouring cap according to claim 1.

7. The double container pouring cap according to claim 1, wherein an upper surface of the outer end portion, opposite of the lower surface of the outer end portion, is not in contact with the second abutting surface.

8. A double container pouring cap attached to a container body including an inner layer body having a filling space that accommodates content liquid and an outer layer body partitioning an inner space between the inner layer body and the outer layer boy and including a vent that leads to the internal space, and pours out the content liquid in the filling space by pressing the outer layer body from a pouring outlet, the double container pouring cap comprising:

a cap body covering the vent and attached to the outer layer body, and including the pouring outlet and an outside air inlet that leads to the vent:

an air valve that can abut on and separate from a back surface of the cap body, and blocks air flow from the vent to the outside air inlet while allowing air flow from the outside air inlet to the vent; and an inner plug provided to face the back surface of the cap body with the air valve interposed between, and including a regulation part that abuts on a part of the air valve and limits separation of the air valve from the back surface of the cap body, wherein a first abutting surface of the air valve where the regulation part abuts is a flat surface, the inner plug includes a partition wall having a content liquid communication port that allows the filling space to communicate with the pouring outlet, an annular wall standing up from the partition wall, an air communication port penetrating at least one of the partition wall and the annular wall and allows the outside air inlet to communicate with the vent, and a plate-shaped part connected to the annular wall and separated from a lower surface of the air valve to extend along an outer edge part of the air valve, an outer edge of the air valve extends along an inner peripheral surface of the annular wall, the plate-shaped part extends radially inward from the inner peripheral surface of the annular wall and then extends in an arc along the inner peripheral surface of the annular wall, wherein the plate-shaped part includes an abutting part provided at a tip of the arc-shaped part and abutting on the lower surface of the air valve, and the regulation part includes the plate-shaped part and the abutting part.

9. The double container pouring cap according to claim 8, wherein the plate-shaped part is thinner than the abutting part.

10. The double container pouring cap according to claim 9, wherein the air communication port penetrates at least the annular wall, and a lower surface of the plate-shaped part is at a position aligned with a lower surface of the annular wall that partitions the air communication port.

11. The double container pouring cap according to claim 8, wherein the air communication port penetrates at least the annular wall, and a lower surface of the plate-shaped part is at a position aligned with a lower surface of the annular wall that partitions the air communication port.

12. The double container pouring cap according to claim 8, wherein the first abutting surface and a regulation part abutting surface where the regulation part abuts on the first abutting surface are both flat surfaces.

13. A double container comprising the container body and the double container pouring cap according to claim 8.

* * * * *